US010513903B2

(12) United States Patent
Farias et al.

(10) Patent No.: US 10,513,903 B2
(45) Date of Patent: Dec. 24, 2019

(54) ELECTRICAL SUBMERSIBLE PUMP TREE CAP

(71) Applicant: Aker Solutions Inc., Houston, TX (US)

(72) Inventors: Moacir Farias, Houston, TX (US); Rodrigo Bernardes, Houston, TX (US)

(73) Assignee: AKER SOLUTIONS INC., Houston, TX (US)

( * ) Notice: Subject to any disclaimer, the term of this patent is extended or adjusted under 35 U.S.C. 154(b) by 0 days.

(21) Appl. No.: 14/772,569

(22) PCT Filed: Oct. 25, 2013

(86) PCT No.: PCT/US2013/066883

§ 371 (c)(1),
(2) Date: Sep. 3, 2015

(87) PCT Pub. No.: WO2014/137407

PCT Pub. Date: Sep. 12, 2014

(65) Prior Publication Data

US 2016/0002997 A1 Jan. 7, 2016

Related U.S. Application Data

(60) Provisional application No. 61/772,215, filed on Mar. 4, 2013.

(51) Int. Cl.
*E21B 33/038* (2006.01)
*E21B 33/035* (2006.01)
(Continued)

(52) U.S. Cl.
CPC ..... *E21B 33/0385* (2013.01); *E21B 33/035* (2013.01); *E21B 33/037* (2013.01); *E21B 43/128* (2013.01)

(58) Field of Classification Search
CPC .. E21B 33/0385; E21B 33/035; E21B 33/037; E21B 43/128
(Continued)

(56) References Cited

U.S. PATENT DOCUMENTS 5,377,747 A 1/1995 Didier
2003/0056956 A1 3/2003 Collie et al.
(Continued)

FOREIGN PATENT DOCUMENTS

WO 97/49892 A1 12/1997
WO WO 9749892 A1 * 12/1997 ..... E21B 33/035
(Continued)

OTHER PUBLICATIONS

Written Opinion issued in European Patent Application No. 13 789 127.1, dated Jan. 19, 2017, 6 pgs.
(Continued)

*Primary Examiner* — Matthew R Buck
*Assistant Examiner* — Patrick F Lambe
(74) *Attorney, Agent, or Firm* — Rothwell, Figg, Ernst & Manbeck, P.C.

(57) ABSTRACT

Systems and methods providing a tree cap that allows power, signal, and/or hydraulic function connections to be established between an Electrical Submersible Pump and a vertical Christmas tree (VXT) control system are provided. The tree cap includes an Electrical Feed-through System (EFS) having an electro-hydraulic stinger configured to form a connection to an ESP hanger plug of the Electrical Submersible Pump (ESP). The tree cap is configured to lock onto the vertical Christmas tree (VXT) and provide a secondary seal barrier element to the environment.

5 Claims, 2 Drawing Sheets

(51) Int. Cl.
*E21B 33/037* (2006.01)
*E21B 43/12* (2006.01)

(58) Field of Classification Search
USPC ..... 166/360
See application file for complete search history.

(56) References Cited

U.S. PATENT DOCUMENTS

| | | | | |
|---|---|---|---|---|
| 2004/0070463 | A1 | 4/2004 | Collie et al. | |
| 2010/0307763 | A1 | 12/2010 | Moe | |
| 2011/0120722 | A1 * | 5/2011 | Scranton | E21B 33/0355 166/360 |

FOREIGN PATENT DOCUMENTS

| | | | | |
|---|---|---|---|---|
| WO | 2012/045771 | A1 | 4/2012 | |
| WO | WO 2012045771 | A2 * | 4/2012 | E21B 33/072 |
| WO | 2012/098464 | A2 | 7/2012 | |
| WO | 2012/148288 | A1 | 11/2012 | |
| WO | 2014/028553 | A1 | 2/2014 | |

OTHER PUBLICATIONS

Office Action issued in Canadian Application No. 2,902,807, dated Sep. 20, 2019, 3 pages.

* cited by examiner

ELECTRICAL SUBMERSIBLE PUMP TREE CAP

CROSS REFERENCE TO RELATED APPLICATIONS

This application is a 35 U.S.C. § 371 National Phase Entry Application from PCT/US2013/066883, filed Oct. 25, 2013, and designating the United States, which claims the benefit of U.S. Provisional Patent Application No. 61/772,215 filed Mar. 4, 2013, which are incorporated herein by reference in their entireties.

FIELD OF THE INVENTION

The present invention relates generally to subsea well assemblies and, more particularly, to methods and systems for providing a Tree Cap to Christmas Tree equipment.

BACKGROUND OF THE INVENTION

In the field of subsea hydrocarbon wells, it is common to utilize "Christmas Trees" when recovering materials, such as Oil or Gas, from a well. Christmas Trees perform a number of functions and may be configured to, for instance, direct the production of materials to a flow line in the production Tree, regulate fluid flow, monitor well parameters, such as pressure and temperature, and provide safety means to stop flow.

Traditionally, a Christmas Tree (or "Xmas tree" or "XT") is categorized as either a "Horizontal" XT (HXT) or a conventional or "Vertical" XT (VXT). A typical VXT may include, for instance, a production and annulus bore that pass vertically through the Tree body, a Tubing Hanger system, valves, and one or more control systems. A VXT may also include a number of gate valves configured above the Tubing Hanger, which lands in the wellhead or Tubing Head Spool, such that a subsea VXT may be recovered without the need to recover the downhole completion. It is common for the master valve and swab valve of a VXT to be stacked vertically. A VXT may also be fitted with a Tree Cap to seal the Tree from the external environment and provide an additional barrier to internal pressure.

However, present equipment or VXTs do not enable the operation of a downhole Electrical Submersible Pump (ESP) via a wet-mate connection of power, signal, and/or hydraulic lines while providing a secondary pressure barrier to the environment.

Accordingly, there is a need for systems and methods to provide a Tree Cap that allows power, signal, and/or hydraulic function connections to be established between an Electrical Submersible Pump and a Vertical Christmas tree (VXT) control system.

SUMMARY OF THE INVENTION

According to embodiments of the present invention, a Tree Cap is disclosed that allows power, signal, and/or hydraulic function connections to be established between an Electrical Submersible Pump (ESP) and a Vertical Christmas Tree (VXT) control system through the ESP tree cap. In certain aspects, the Tree Cap includes an Electrical Feed-through System (EFS) having an electro-hydraulic stinger configured to form a connection to an ESP Hanger Plug of the Electrical Submersible Pump. The Tree Cap is configured to lock onto the VXT and provide a secondary barrier element, for instance metal-to-metal or resilient seal as an option, to the environment.

In one particular aspect, an ESP Tree Cap is provided having a locking mechanism configured to engage a locking surface of a vertical Christmas Tree mandrel of a subsea well assembly. An EFS of the Tree Cap is configured to provide one or more of power, signal, and hydraulic function connections to an ESP within the subsea well assembly. In certain aspects, the EFS includes an electro-hydraulic stinger (112) that is configured to provide the power, signal, and hydraulic function connections between the Electrical Submersible Pump (ESP) and a control system of the vertical Christmas Tree structure. The electro-hydraulic stinger may be extendable to engage a wet-mate connection at an ESP Hanger Plug of the ESP.

According to certain aspects, a method is provided for attaching an ESP Tree Cap to a subsea well assembly having a wellhead or Tubing Head Spool (THS) and vertical Christmas Tree mandrel. The method may include a step of closing one or more production valves of the Vertical Christmas Tree equipment, including the uppermost production valve, and opening a bleed valve. The method may further include a step of locking the Tree Cap to the Vertical Christmas Tree equipment, opening the uppermost production valve, and extending a stinger to engage an ESP Hanger Plug of a downhole ESP of the subsea well assembly. In certain aspects, the stinger may be part of an EFS that runs through the Tree Cap and provides one or more of power, signal, and hydraulic function connections between the ESP and a control system of the Vertical Christmas Tree equipment. The method may also include a step of locking the EFS after engaging the ESP Hanger Plug in order to prevent vertical movement.

According to certain aspects, embodiments provide a subsea hydrocarbon well assembly that includes a wellhead or a THS, a Vertical Christmas Tree coupled to the wellhead or THS, a Tree Cap, and a downhole ESP. The Tree Cap includes an EFS configured to provide one or more of power, signal, and hydraulic function connections to the ESP by forming a wet-mate connection with an ESP Hanger Plug of the ESP. In certain aspects, the EFS includes an extendable electro-hydraulic stinger.

BRIEF DESCRIPTION OF THE DRAWINGS

The accompanying drawings, which are incorporated herein and form part of the specification, illustrate various embodiments of the present disclosure and, together with the description, further serve to explain the principles of the disclosure and to enable a person skilled in the pertinent art to make and use the embodiments disclosed herein.

DETAILED DESCRIPTION OF THE INVENTION

Particular embodiments of the present invention are directed to a subsea hydrocarbon well assembly that includes a Wellhead or THS, a Vertical Christmas Tree coupled to the Wellhead or THS, and a Tree Cap. The Wellhead and THS may provide, for example, a structural and/or pressurized interface to production equipment of the well assembly. The Tree Cap, for instance, as shown in FIG. 1, includes an EFS configured to provide one or more of power, signal, and hydraulic function connections to an Electrical Submersible Pump (ESP) by forming a wet-mate connection with an ESP Hanger Plug of the ESP, such that the ESP may be externally controlled.

Figure 1:
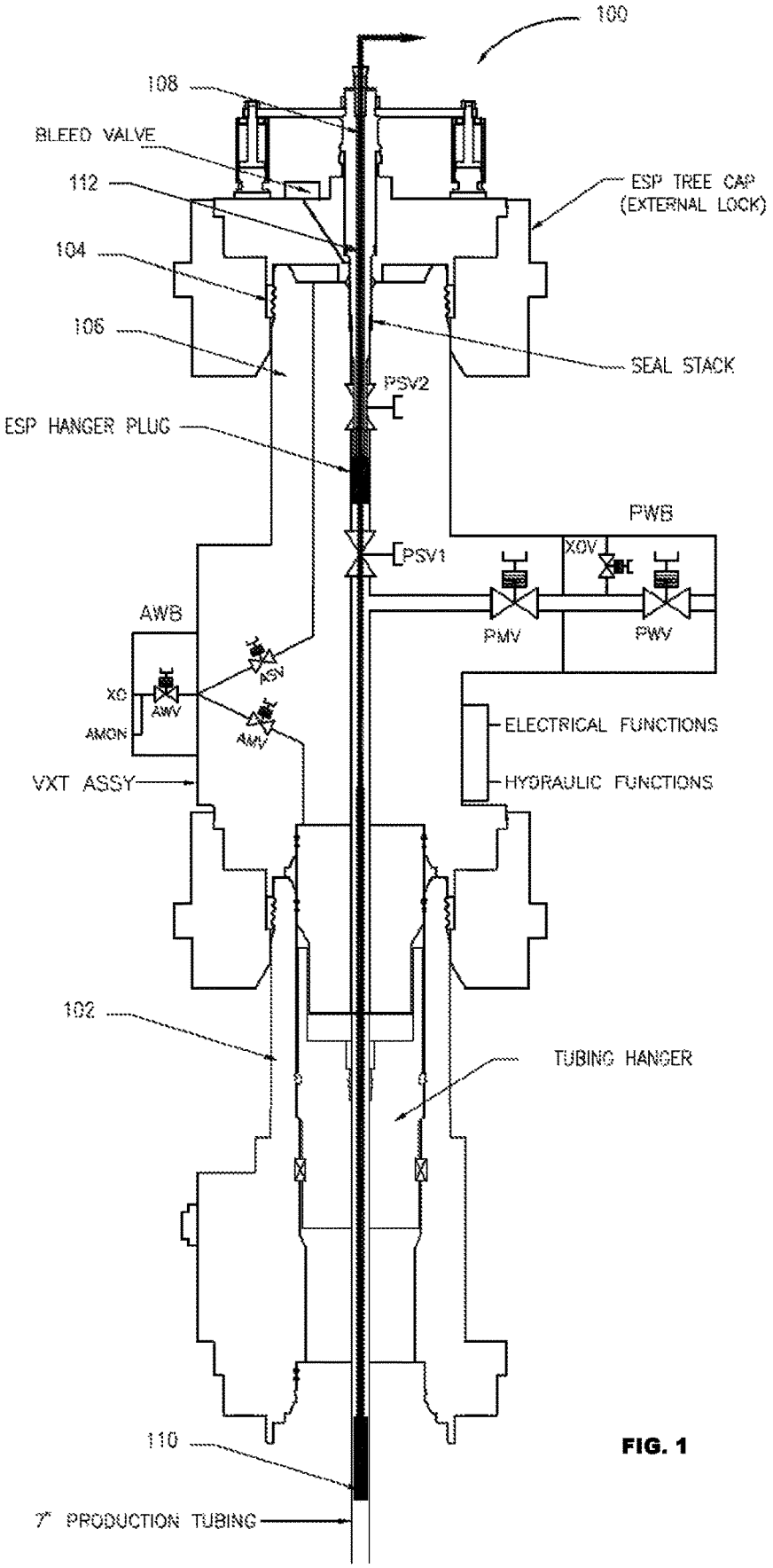
FIG. 1 is an illustration of a capped Vertical Christmas Tree equipment according to embodiments of the present invention.

FIG. 1 illustrates the top portion of a subsea well assembly 100 fitted with an ESP Tree Cap in accordance with certain embodiments of the present invention.

In some embodiments, the assembly 100 includes Vertical Christmas Tree equipment (VXT ASSY) connected to a Tubing Head Spool (THS) 102. The Christmas tree equipment may be used, for example, to control a plurality of functions of the well assembly. The VXT ASSY is fitted with an ESP Tree Cap. The ESP Tree Cap mechanically locks to the VXT ASSY, for example, at the top of the VXT ASSY either internally or externally. An external locking configuration is shown in FIG. 1, with a locking mechanism 104 of the ESP tree cap connected to a mandrel 106 of the VXT ASSY. The locking mechanism, and locking surfaces of the VXT ASSY, may include, for example, split rings, dogs, collets, and/or additional locking components, such that the ESP Tree Cap is in rigid engagement with the VXT ASSY. According to certain aspects, both the VXT ASSY and ESP Tree Cap may have a metallic seal or a resilient seal, providing a secondary sealing barrier element to the environment.

The VXT ASSY includes a plurality of valves. These valves may include, for instance, annulus valves (AMV, ASV, AWV) and production valves (PSV1, PSV2, PMV, PWV). According to certain aspects, the Wellhead and Tubing Head Spool (THS) 102 and VXT ASSY may be adapted for production using an ESP. Accordingly, the VXT ASSY may also include an ESP Hanger Plug for a downhole Electrical Submersible Pump 110. The ESP may be used, for instance, to pump fossil fuels or otherwise aid in the production of fossil fuels in the assembly. In some embodiments, above the ESP Hanger Plug is a seal stack and a stinger feed-through plug 108 with longitudinal and optional rotary movement. As shown in FIG. 1, an optional valve PSV1 may be provided below the ESP hanger plug The ESP Tree Cap, locked onto the VXT ASSY, can be configured with an Electrical Feed-through System (EFS) to provide power, signal, and/or hydraulic function connections between internal and external components. In some embodiments, communication is established when an electro-hydraulic stinger is extended, for instance, hydraulically via a Remotely Operated Vehicle (ROV), to engage a connection within the VXT ASSY, such as a wet mate connection at the top of the ESP hanger plug. In certain aspects, the stinger is configured to slide and optionally rotate along a central axis through the uppermost open valve in the VXT ASSY and includes one or more power, signal, and/or hydraulic lines. The components may be aligned via an orientation key engaging a mating helix of the hanger plug or VXT mandrel.

Figure 2:
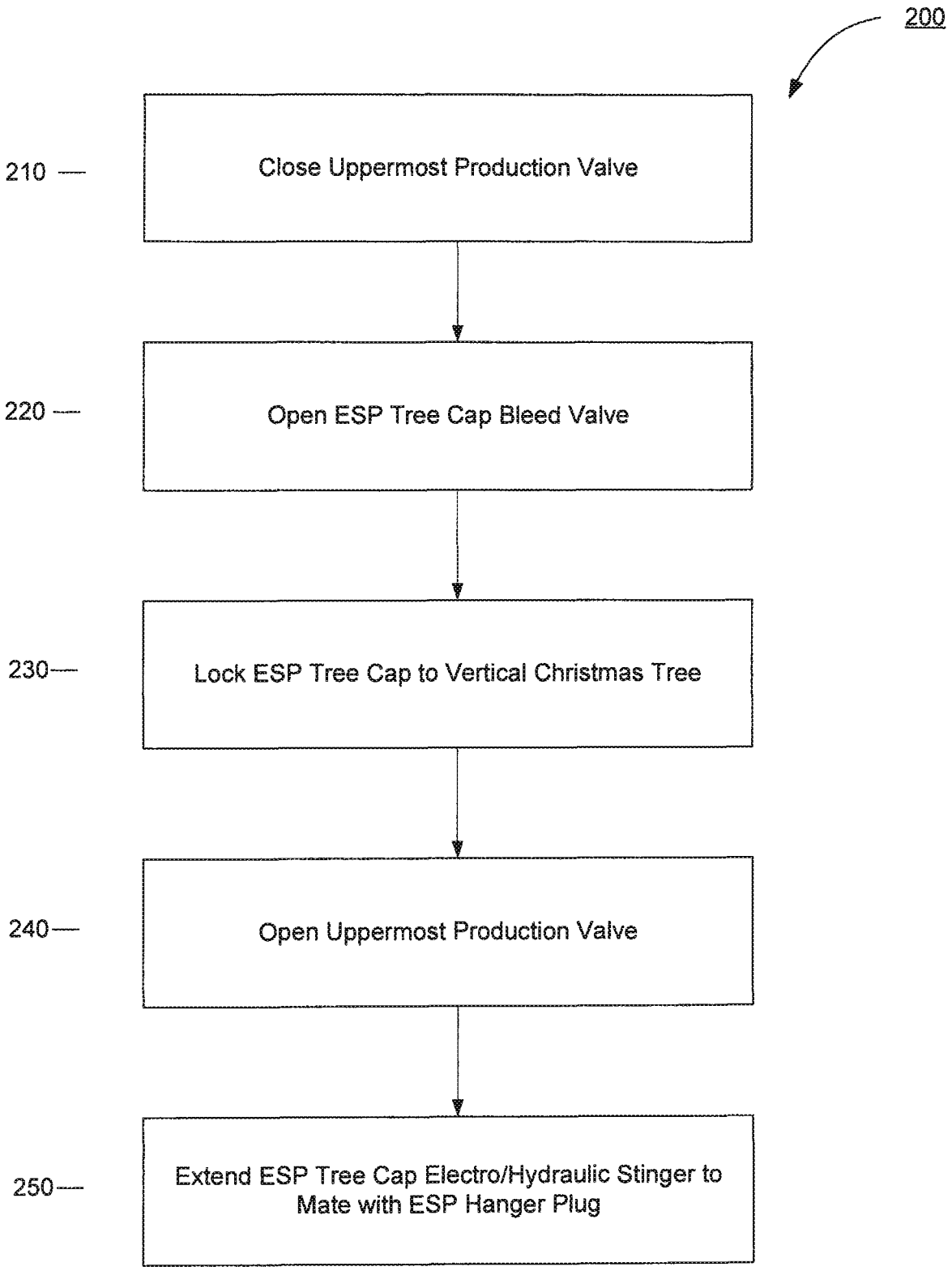
FIG. 2 is a flow chart illustrating a process for capping a Vertical Christmas Tree equipment in accordance with embodiments of the present invention.

Referring now to FIG. 2, a flow chart 200 illustrating an exemplary process for attaching a Tree Cap to a subsea well assembly having a Wellhead or THS and a Vertical Christmas Tree equipment is shown. In embodiments, process 200 may be implemented with the equipment described in connection with FIG. 1.

In step 210, a production valve between a Tree Cap locking location and the subsea wellhead is closed. This may, for instance, be the uppermost production valve of the Vertical Christmas Tree equipment, such as valve PSV2 shown in FIG. 1.

In step 220, a bleed valve is opened. The bleed valve can be used, for example, to adjust pressure in the subsea assembly.

After the production valve is closed and a bleed valve is opened, the ESP tree cap is locked onto the vertical Christmas tree mandrel in step 230. The ESP tree cap can be either an internal or external lock style. An exemplary externally locked ESP tree cap is shown in FIG. 1, and is attached to the vertical tree equipment via its locking surfaces and the locking mechanism of the tree cap.

Once the ESP tree cap is locked onto the VXT, the production valve is re-opened in step 240. Opening of the uppermost production valve permits access to the ESP hanger plug by an Electrical Feed-through System (EFS) of the tree cap, which extends through the tree cap. As shown in FIG. 1, the EFS may include an electro-hydraulic stinger with longitudinal and optional rotary movement. The EFS provides a means to connect power, signal, and hydraulic functions between the ESP and the assembly's control system, which may be provided, for instance, on the VXT or other remote equipment. The EFS may include at least one power, signal, or hydraulic line and/or combinations of each.

In step 250, an electro-hydraulic stinger is extended to mate with the top of the ESP hanger plug and form a wet mate connection. For instance, signal, power, and/or hydraulic function communication to the ESP may be established at this time. The extension may be performed via any number of known techniques, including but not limited to Remotely Operated Vehicle (ROV) operation. According to certain embodiments, the electro-hydraulic stinger can be slid and optionally rotated along its central axis, through the uppermost open valve in the VXT, to align and orient with the ESP hanger plug via an orientation key which engages a mating helix of the hanger plug or in the VXT mandrel.

In certain aspects, the method 200 may further include locking the electro-hydraulic stinger, for instance, using a locking mechanism of either the tree cap or VXT, in order to prevent vertical movement of the stinger after engagement with the ESP hanger plug.

While various embodiments have been described above, it should be understood that they have been presented by way of example only, and not limitation. Thus, the breadth and scope of the present disclosure should not be limited by any of the above-described exemplary embodiments. Moreover, any combination of the above-described elements in all possible variations thereof is encompassed by the disclosure unless otherwise indicated herein or otherwise clearly contradicted by context.

Additionally, while the processes described above and illustrated in the drawings are shown as a sequence of steps, this was done solely for the sake of illustration. Accordingly, it is contemplated that some steps may be added, some steps may be omitted, the order of the steps may be re-arranged, and some steps may be performed in parallel.

What is claimed is:

1. A method for attaching a tree cap to a subsea fossil fuel well assembly having a wellhead or tubing head spool (THS) for providing a structural and/or pressurized interface to production equipment of said well assembly, and vertical Christmas tree equipment controlling a plurality of functions of said subsea well assembly, comprising:

closing one or more production valves of said vertical Christmas tree equipment, wherein said one or more production valves includes an uppermost production valve of said vertical Christmas tree equipment and is configured to control production flow of said fossil fuel;

opening a bleed valve configured to adjust pressure in said subsea assembly;

locking said tree cap to an upper portion of said vertical Christmas tree equipment; and after locking said tree cap to an upper portion of said vertical Christmas tree equipment, opening said uppermost production valve and after locking said tree cap to an upper portion of said vertical Christmas tree equipment, extending a stinger through a production bore of said subsea assembly by longitudinally moving said stinger through said uppermost production valve until the stinger engages an ESP hanger plug of an Electrical Submersible Pump (ESP) of said subsea assembly, such that said ESP can be controlled by an external control system of said subsea assembly, wherein said stinger is part of an Electrical Feed-through System (EFS) that extends through said tree cap and provides one or more of power, signal, and hydraulic function connections between said Electrical Submersible Pump (ESP) and said control system.

2. The method of claim 1, further comprising:

locking, using one or more locking mechanisms of said tree cap and Christmas tree equipment, the Electrical Feed-through System (EFS) in a connected position after said engagement to the ESP hanger plug to prevent vertical movement of said EFS.

3. The method of claim 1, wherein said extending further comprises rotating said stinger along a central axis thereof through said uppermost production valve.

4. The method of claim 3, further comprising:

aligning and orienting said stinger with said ESP hanger plug via an orientation key that engages a mating helix of said ESP hanger plug or mandrel of said vertical Christmas tree.

5. The method of claim 1, wherein said extending includes operating one or more Remotely Operated Vehicles (ROVs) to move said stinger.

* * * * *